United States Patent [19]

Combs

[11] Patent Number: 5,005,705

[45] Date of Patent: Apr. 9, 1991

[54] PACKAGE FOR SHIPPING FLUORESCENT LAMPS AND OTHER FRAGILE TUBULAR PRODUCTS

[75] Inventor: Kenneth Combs, Warrensville Heights, Ohio

[73] Assignee: General Electric Company, Schenectady, N.Y.

[21] Appl. No.: 500,424

[22] Filed: Mar. 28, 1990

[51] Int. Cl.[5] ..... B65D 81/02; B65D 85/42

[52] U.S. Cl. ..... 206/586; 206/419; 206/443

[58] Field of Search ..... 206/419, 420, 418, 443, 206/446, 586, 588, 589, 591, 592, 594, 521; 229/9, 19

[56] References Cited

U.S. PATENT DOCUMENTS

| | | | |
|---|---|---|---|
| 944,616 | 12/1909 | Jenkins | 206/418 |
| 1,008,963 | 11/1911 | Ekermeyer | 206/591 X |
| 1,256,031 | 2/1918 | Miller, Jr. | 206/223 X |
| 1,392,791 | 10/1921 | Pettee | 206/586 X |
| 1,701,059 | 2/1929 | Andrews | 206/418 |
| 1,850,329 | 3/1932 | Metzger | 206/594 X |
| 2,564,729 | 8/1951 | Shepard | 206/419 |
| 2,653,708 | 9/1953 | Spalding | 206/446 |
| 2,828,902 | 4/1958 | Ringler | 206/594 X |
| 2,838,173 | 6/1958 | Emery | 206/419 |
| 2,867,367 | 1/1959 | Butz | 206/586 |
| 3,163,312 | 12/1964 | Chaplin | 206/419 X |
| 3,223,234 | 12/1965 | Weiss | 206/419 |
| 3,572,574 | 3/1971 | Mears | 206/586 X |
| 3,648,920 | 3/1972 | Stup | 206/586 X |
| 4,724,960 | 2/1988 | Goodwin et al. | 206/586 X |

FOREIGN PATENT DOCUMENTS

| | | | |
|---|---|---|---|
| 0256037 | 8/1926 | United Kingdom | 206/418 |
| 0297571 | 9/1928 | United Kingdom | 206/418 |

*Primary Examiner*—Bryon P. Gehman

*Attorney, Agent, or Firm*—Edward M. Corcoran; Stanley C. Corwin; Fred Jacob

[57] ABSTRACT

A package for shipping fluorescent lamps comprising a rectangularly shaped first carton closed at both ends and containing the lamps within and being disposed inside a second rectangularly shaped carton with the longitudinal axis of both cartons parallel and the first carton being rotated inside the second carton such that the four longitudinal sides of the first carton contact the respective side wall inside the second carton to form four triangularly shaped cavities and wherein two of the cavities contain a triangularly shaped spacer to prevent rotation of the first carton within the second carton.

16 Claims, 3 Drawing Sheets

Fig. 1(a)
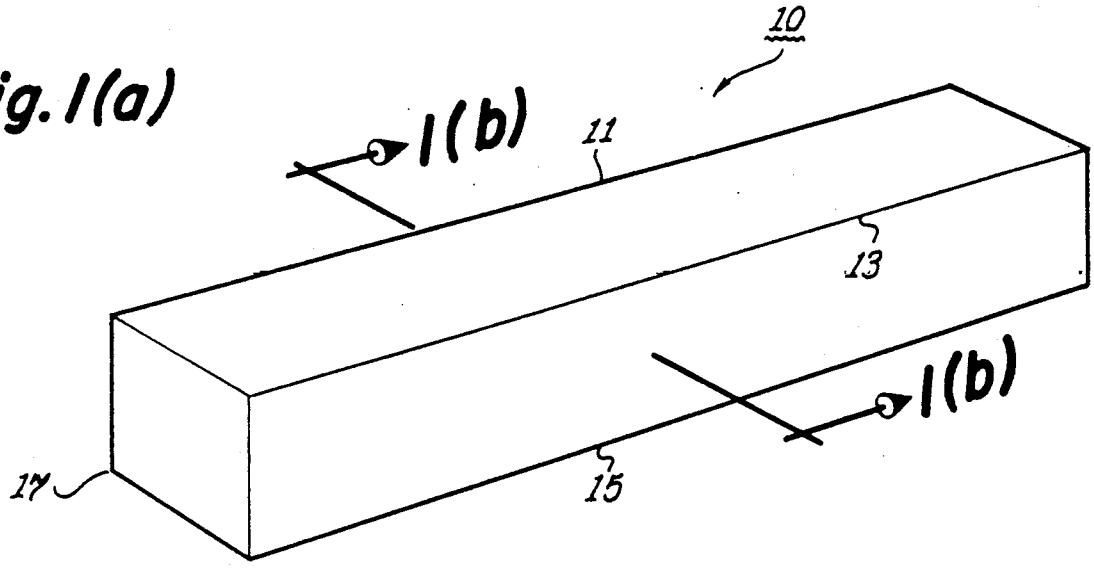
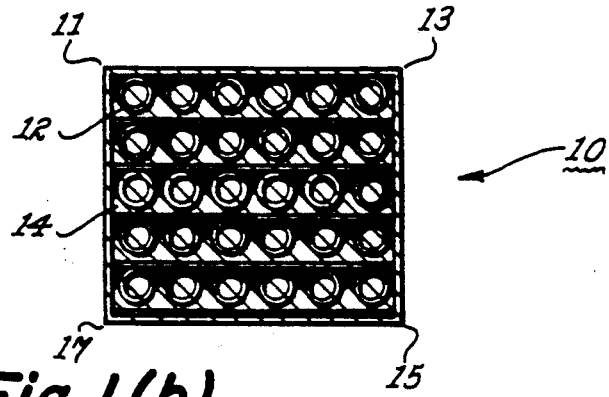
Fig. 1(b)
Fig. 2
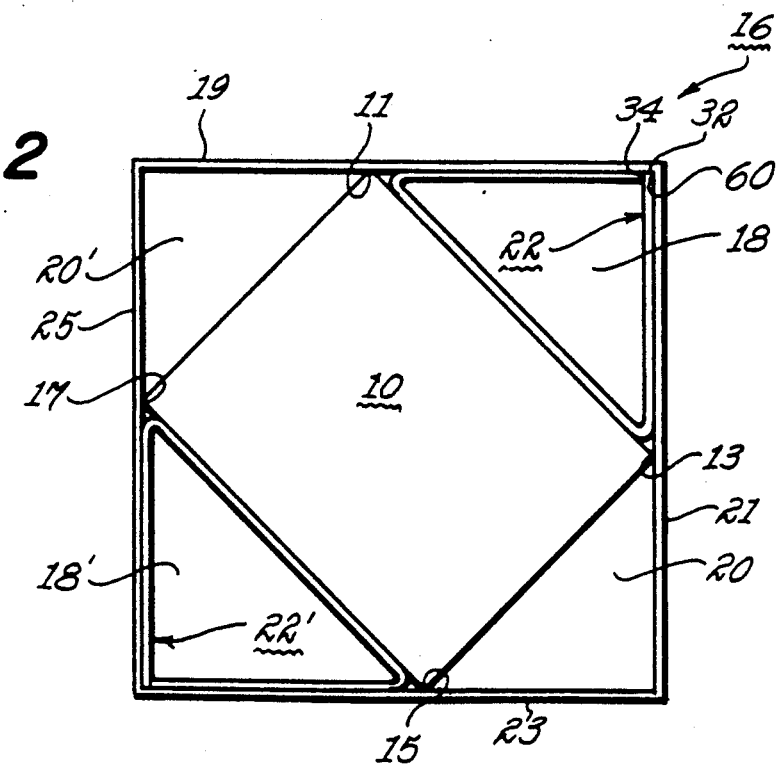

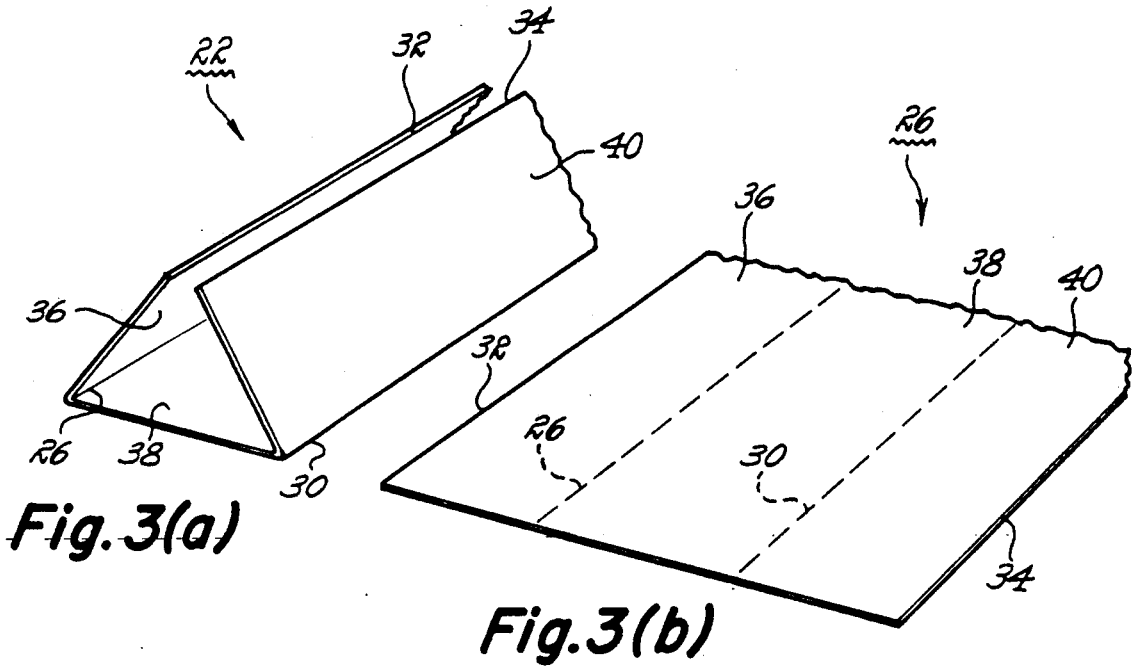
Fig.3(a)
Fig.3(b)
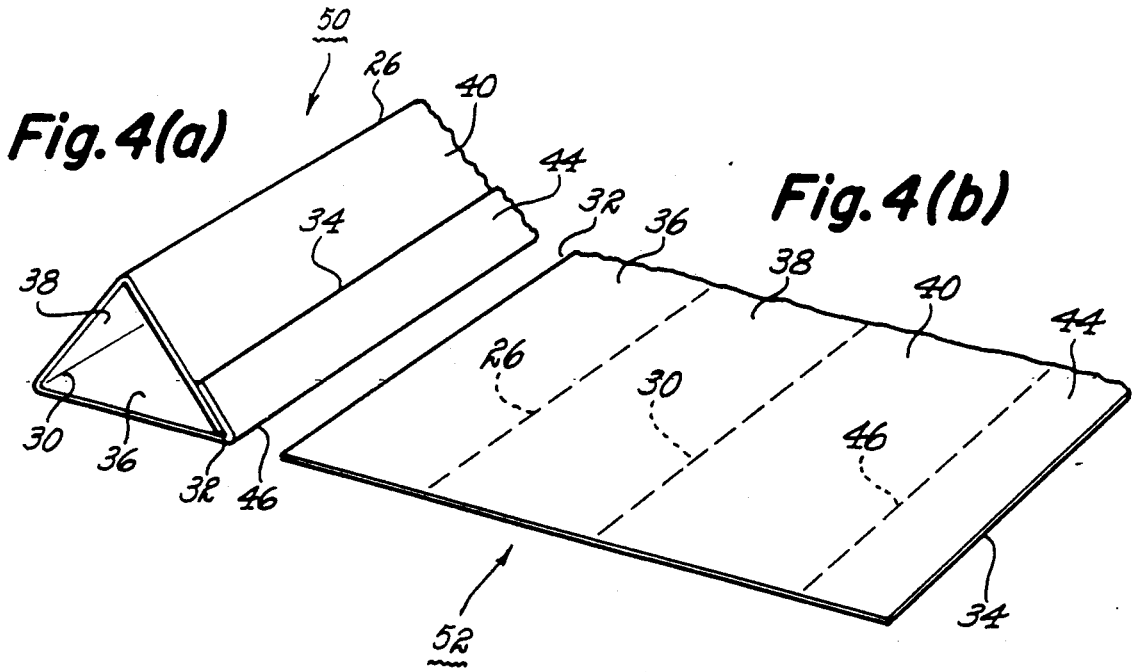
Fig.4(a)
Fig.4(b)

PACKAGE FOR SHIPPING FLUORESCENT LAMPS AND OTHER FRAGILE TUBULAR PRODUCTS

BACKGROUND OF THE INVENTION

1. Field of the Invention

The present invention relates to a package for storing and shipping fragile tubular articles such as fluorescent lamps and other similarly shaped fragile articles. More particularly, the present invention relates to a package for shipping fragile tubular articles such as fluorescent lamps, glass tubing and the like comprising a first carton being rectangularly shaped and containing a plurality of said articles within which have their longitudinal axes parallel to the longitudinal axis of said first carton, with said first carton being disposed within a second rectangularly shaped carton such that the longitudinal axes of both cartons are substantially coincident and with each of the four longitudinal edges of the first carton contacting a separate side inside of said second carton to form four triangular-shaped cavities inside said second carton and wherein at least two of said triangular-shaped cavities each contain a triangularly shaped spacer to prevent rotation of said first carton inside said second carton and to provide additional rigidity and stiffness to said package.

BACKGROUND OF THE DISCLOSURE

A variety of boxboard or fiberboard cartons generically referred to as cardboard or corrugated cartons have been designed and used to protect various types of electric lamps as is well known both to consumers and to those skilled in the art. Fluorescent lamps are usually packaged in an inexpensive paper carton or sleeve that provides little if any protection to the lamp contained therein from breaking due to crushing forces or to impact with foreign objects or to stresses applied perpendicular to the longitudinal axis of the tube-shaped lamp. When these lamps are shipped in bulk from a manufacturer or distributor they are generally shipped in rectangular shaped boxboard cartons closed at both ends. In one method of shipping where the lamps are intended for sale or distribution to the consumer and industrial market, each lamp is inserted into a relatively thin, generally square-shaped paper or boxboard sleeve and then placed in a carton in the form of layers of lamps. A typical carton for a standard four foot fluorescent lamp is rectangular shaped having dimensions of about ten and a half inches on two of the opposing sides and eight and three-quarter inches on the other two opposing sides and will contain five layers of six lamps in each layer for a total of thirty lamps. Where the lamps are intended for commercial use, instead of each lamp being inserted into a separate sleeve, each layer of lamps rests on a molded paper pulp tray type of spacer which separates the lamps and layers from each other. A typical carton is shown in FIG. 1. Thus, FIG. 1(*b*) shows carton 10 in cross-section containing five rows of six fluorescent lamps 12 each, wherein each row and each lamp is separated by means of trays or spacers 14. Such cartons have to be handled and shipped extremely carefully due to the fragile nature of the contents. Forces applied to the top, bottom or sides of the carton will act to compress and crush the fluorescent lamps contained therein. The lamp-containing carton has little, if any, resistance to crushing or flexing forces and any such forces applied to the carton will break all or a portion of the lamps contained inside, depending on the strength of the force. To make a carton of material strong and rigid enough to contain such lamps, be flexible and resistant to compressive forces, thereby minimizing breakage of the lamps contained therein, has not been economically feasible.

Accordingly, such cartons of lamps and other similarly shaped, fragile articles such as glass and ceramic rod and tubing, etc., must be handled and shipped very carefully which, in the past, has been done by private carrier. This necessitates extremely careful handling as well as coordinating shipping orders to try to minimize both breakage and the high cost of shipping by private carrier. It would result in a substantial cost savings if common carrier shippers could be employed to transport such lamps and other similar devices to various parts of the country from their source of manufacture or from distributors. Common carriers will not accept for shipment cartons of lamps and other similar articles packaged as shown in FIG. 1, because of the high breakage rate of the contents. Accordingly, there is a substantial need for an inexpensive and effective means of packaging such lamps and similarly shaped fragile articles for shipment via common carrier from manufacturing and distribution locations to customers.

SUMMARY OF THE INVENTION

The present invention relates to a package for shipping fragile tubular articles such as fluorescent lamps or other similarly shaped fragile articles which comprises a first carton being rectangularly shaped, having four longitudinal outside edges, closed at both ends, and containing a plurality of said articles within, with the longitudinal axes of said articles being parallel to the longitudinal axis of said first carton, with said first carton being disposed within a second rectangularly shaped carton such that the longitudinal axes of both cartons are substantially coincident and each of the said four longitudinal edges of said first carton are located adjacent a respective one of the four sides of said second carton inside said second carton to form four triangularly shaped cavities inside said second carton and wherein at least one of said triangular-shaped cavities contains a spacer to prevent rotation of said first carton within said second carton. In the context of the invention rectangular is meant to include square. Preferably at least two and more preferably at least two diametrically opposite triangular-shaped cavities will contain a spacer to prevent rotation of said first carton within said second carton. Still more preferably said spacers will provide additional rigidity and stiffness to said package. In one preferred embodiment the spacers will be triangularly shaped.

Independent laboratory tests made on packages of the present invention, wherein the first or inside carton contained thirty fluorescent lamps, each having a nominal outside diameter of one and a quarter inches and a length of four feet and wherein two diametrically opposing triangular cavities each contained a triangularly shaped, boxboard spacer, showed that packages according to this invention were substantially superior to the package depicted in FIG. 1 in terms of preventing or minimizing lamp breakage in compression and drop tests. Moreover, packages of this invention are now being successfully employed to ship fluorescent lamps by common carrier.

BRIEF DESCRIPTION OF THE DRAWINGS

FIG. 1 schematically illustrates a simple carton containing thirty fluorescent lamps, each having a length of about four feet and a nominal outside diameter of one and a half inches.

FIG. 2 schematically illustrates one embodiment of a package according to the present invention containing two diametrically opposed, triangular-shaped spacers.

FIG. 3 is a schematic view of one embodiment of a triangular spacer useful in the practice of the invention and a boxboard blank from which the spacer is formed.

FIG. 4 is a schematic view of another embodiment of a triangular spacer useful in the practice of the invention and a boxboard blank from which the spacer is formed.

DETAILED DESCRIPTION

Figure 5B:
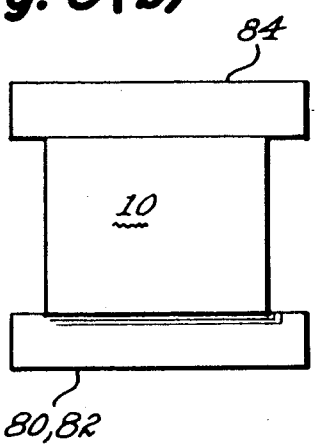
FIGS. 5 and 6 schematically illustrate orientation of a carton of the prior art and a package of the invention, respectively, for a compression test.

As set forth above, FIG. 1 schematically illustrates a boxboard carton 10 sealed at both ends and having four longitudinal edges 11, 13, 15 and 17. FIG. 1(*b*) illustrates a section taken across carton 10 showing lamps 12 separated by spacers 14. Spacers 14 are molded paper pulp trays similar to molded paper egg cartons.

Turning now to FIG. 2 there is shown a schematic end view of one embodiment of a package according to the present invention wherein carton 10 which is illustrated in FIG. 1 as containing thirty lamps 12 separated by spacers 14 is shown disposed inside carton 16 so that the surface of each of the four longitudinal side panels of carton 10 are at an angle with respect to the surface of each of a respective longitudinal panel, wall or side (19, 21, 23 and 25) of carton 16. The four longitudinal edges 11, 13, 15 and 17 of carton 10 each touch the inside surface of respective sides 19, 21, 23 and 25, of carton 16 to define triangular cavities 18, 18', 20 and 20'. Triangular spacers 22 and 22' are shown inserted into diametrically opposite cavities 18 and 18', respectively. These triangular spacers act to prevent rotational movement of carton 10 within carton 16 and, at the same time, provide additional rigidity and stiffness to the overall package. If desired, additional spacers may be inserted into cavities 20 and 20'. Carton 10 is sealed at both ends in the usual fashion by means of two opposing pairs of glue flaps (not shown), one pair of which overlaps the other as is known to both laymen and to those skilled in the art. Sealing both ends of carton 10 is important in order to provide rigidity and resistance to deformation or collapsing of the carton both longitudinally and in a direction perpendicular to the longitudinal axis. Further, the spacers 22 and 21 are illustrated as being dimensioned so that the three sides thereof are about the same lengths as those of the respective sides of cartons 10 and 16 which they contact to avoid rotation or shifting of carton 10 inside carton 16.

FIG. 3 shows in schematic fashion a typical construction for a triangular spacer (i.e., 22 or 22'). Thus, referring to FIG. 3(*b*), blank 26 from which spacer 22 is formed is a unitary blank consisting of a series of three consecutively arranged, rectangular-shaped panels 36, 38 and 40 hingedly connected along parallel fold lines 28 and 30 and having longitudinal end edges 32 and 34. Folding the blank along lines 28 and 30 forms panels 36, 38 and 40, respectively, with the folded spacer depicted in FIG. 3(*a*). It is to be noted that the longitudinal edges 32 and 34 of the triangular spacers are shown in FIG. 2 as abutting each other at the inside corner 60 of carton 16 formed by the intersection of sides 19 and 21. This embodiment minimizes the chance of edges 32 and 34 slipping past each other and collapsing the triangle thereby depreciating or destroying the effectiveness of the spacer as would more probably occur if edges 32 and 34 formed either of the other two edges of the triangle adjacent carton 10.

FIG. 4 shows another embodiment of a triangular cardboard spacer similar to spacer 22. Thus, spacer 50 is shown as being similar to spacer 22 except having an additional panel 44. Turning to FIG. 4, blank 52 is shown similar to blank 26 except for the presence of an additional longitudinal fold line 46 which, along with longitudinal edge 34 defines additional panel 44. FIG. 4(*a*) shows the spacer 50 folded in the form of a triangle for use with the present invention wherein panel 44 overlaps panel 36. It should be noted that panel 44 does not have to be the same size as panel 40 but may be substantially smaller in width than panel 40 and still achieve the desired result. In this embodiment of FIG. 4 positioning of the spacer in the triangular space does not effect its performance as does the embodiment in FIG. 3.

Those skilled in the art will know that the spacers employed with the present invention can be made out of other materials such as a foamed plastic material (i.e., styrofoam), wood, metal, plastic, etc., and,. further, although a triangular shape is preferred, other shapes should also work. Further, the triangular spaces may, if desired, be filled with a plurality of articles or materials which fill up the space and/or otherwise prevent carton 10 from rotating within carton 16.

EXAMPLE

A number of standard cartons according to FIG. 1 were made from fiberboard or boxboard (commonly known as cardboard), being approximately four feet long and having external dimensions of ten and a half inches on two opposing sides and eight and three-quarter inches on the other two respective opposing sides. Each carton contained thirty fluorescent lamps (five rows of six lamps in each row) having a nominal length of four feet, an outer diameter of one and one-half inches and containing molded paper pulp spacers as shown in FIG. 1 for separating the lamps and preventing their touching each other. The cartons each possessed four end flaps on each end (not shown) folded over in a conventional manner and glued or adhesively bonded to make a sealed carton. The sealed ends also provide rigidity to the carton. Some of these packages were inserted as shown in FIG. 2 into another fiberboard box thirteen inches square and approximately four feet long and two triangular spacers diametrically opposing each other as shown in FIG. 2 also made of fiberboard were also employed. The fiberboard was of a double wall construction with rated specifications having a bursting test of 200 pounds per square inch with a minimum combination weight facings of 84 pounds per thousand square feet. A number of these boxes and packages according to the present invention were submitted to an independent testing laboratory for compression and drop testing.

Figure 6B:
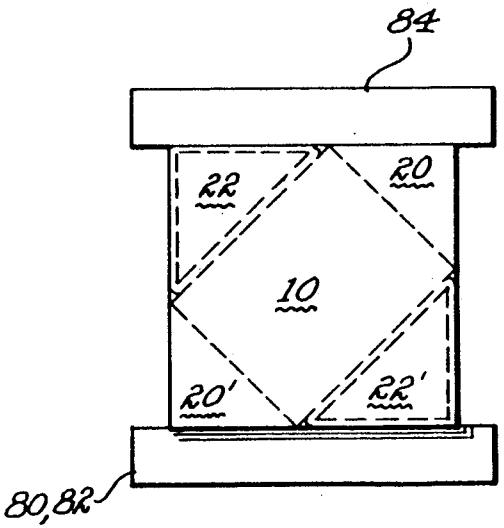
Figure 5A:
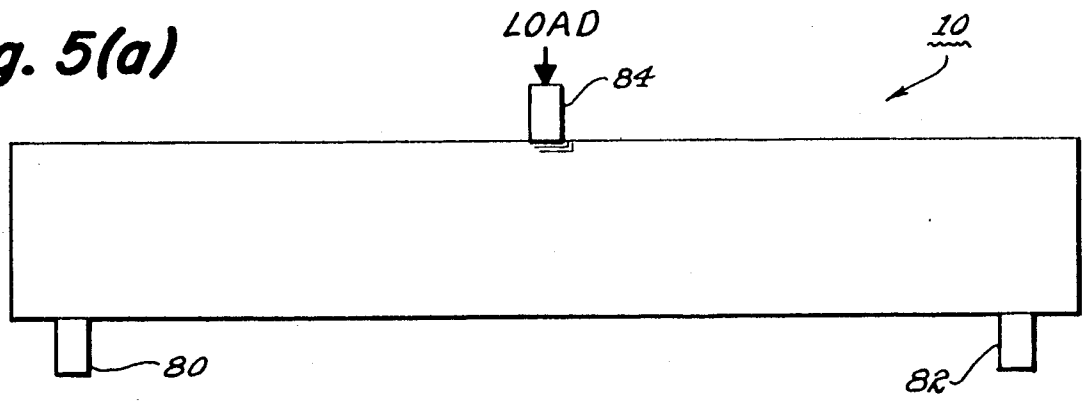
Figure 6A:
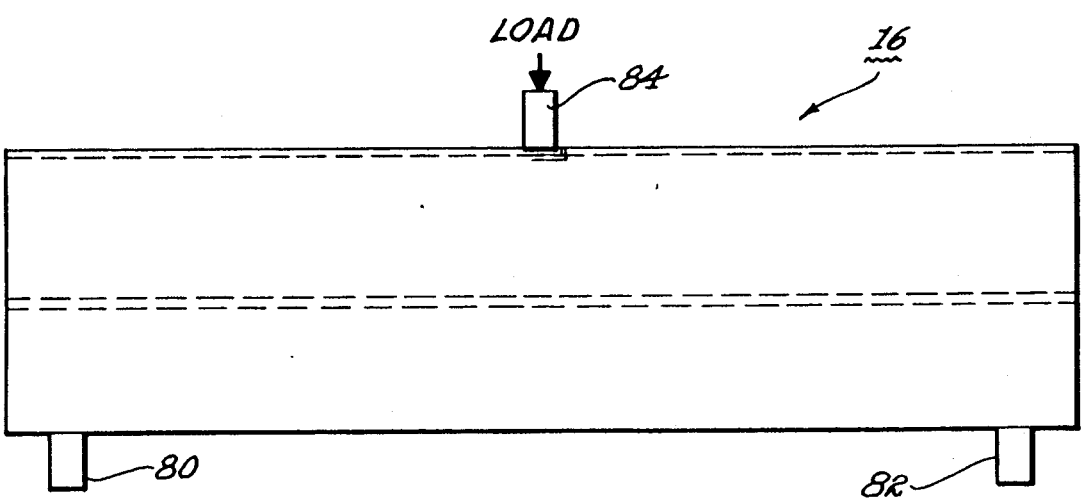

The compression tests were made as shown in FIG. 5 and FIG. 6. That is, two pieces of wood 80 and 82 were placed three inches in from both ends of the carton or package and another piece of (2×4) wood 84 placed on top at the middle and a load applied.

For the carton of the prior art as shown in FIGS. 1 and 5, the average load and deflection causing lamp tube breakage was 768 pounds and 0.69 inches deflection. The average number of lamps broken per test was slightly over six. In contrast, for the package of the present invention the average load and deflection causing breakage in four separate tests was 289 pounds and 2.53 inches. The average number of lamps broken per test averaged between one and two. It is to be noted that the greater breakage experienced with the prior art carton has been found in practical applications to be due to a lack of deflection ability when in compression applied perpendicular to the longitudinal axis of the carton. The three point compression test showed that while the prior art carton was able to generate higher loads at failure, the deflection was only 27% as great as that with the package of the present invention and produced five times as many broken lamps.

Drop tests were performed in which the package and carton orientation in the drop test was the same as that in the compression test except that blocks were not used. In the drop test, tube or lamp breakage was the end point of the test. The lowest height established to cause breakage for the prior art carton was twenty-two inches. This drop height served as a base line for the performance of the package of the present invention. The maximum capability of the machine for the drop test was sixty three inches. In only one drop test from this height with the package of the present invention was a lamp broken. Accordingly, while the laboratory was unable to establish a breakage threshold for the package of the present invention, it was their opinion that it was reasonable to conclude that the threshold drop height for the present invention is in excess of 2.5 times the breakage threshold of the prior art carton.

What is claimed is:

1. A package for shipping fragile tubular or rod-shaped articles, which comprises a first carton being rectangularly shaped and having four longitudinal outside edges and containing a plurality of said articles within, with the longitudinal axis of said articles being parallel to the longitudinal axis of said first carton, with said first carton being disposed within a second rectangularly shaped carton such that the longitudinal axes of both cartons are substantially coincident and each of the said four longitudinal edges of said first carton are located adjacent a respective one of the four sides of said second carton inside said second carton to form four triangular-shaped cavities inside said second carton and wherein at least one of said triangular-shaped cavities contains a triangular-shaped spacer of about the same dimensions as said cavity to prevent rotation of said first carton within said second carton and also to provide additional stiffness and rigidity to said package.

2. The package of claim 1 wherein said first carton is sealed at both ends.

3. The package of claim 2 wherein at least two of said triangular-shaped cavities each contain one of said spacers.

4. The package of claim 3 wherein said first and second cartons are made of paperboard.

5. The package of claim 3 wherein said cavities containing said spacers are diametrically opposed.

6. The package of claim 5 wherein said spacers are made of paperboard.

7. A package for shipping fluorescent lamps which comprises a first carton being rectangularly shaped and having four longitudinal outside edges and containing a plurality of said lamps within, with the longitudinal axes of said lamps being parallel to the longitudinal axis of said first carton, with said first carton being disposed within a second rectangularly shaped carton such that the longitudinal axes of both cartons are substantially coincident and each of the said four longitudinal edges of said first carton are located adjacent a respective one of the four sides of said second carton inside said second carton to form four triangular-shaped cavities inside said second carton and wherein at least one of said triangular-shaped cavities contains a triangular-shaped spacer of about the same dimensions as said cavity to prevent rotation of said first carton within said second carton and also to provide additional stiffness and rigidity to said package.

8. The package of claim 7 wherein said first carton is sealed at both ends.

9. The package of claim 8 wherein at least two of said triangular-shaped cavities each contain one of said spacers.

10. The package of claim 9 wherein said first and second cartons are made of paperboard.

11. The package of claim 9 wherein said cavities containing said spacers are diametrically opposed.

12. The package of claim 11 wherein said spacers are made of paperboard.

13. A sealed paperboard package for shipping fragile articles, which comprises a first carton being rectangularly shaped and having four longitudinal outside edges and containing a plurality of said articles within, said first carton sealed at both ends and being disposed within a second rectangularly shaped carton such that the longitudinal axes of both cartons are substantially coincident and each of the said four longitudinal edges of said first carton are located adjacent a respective one of the four sides of said second carton inside said second carton to form four triangular-shaped cavities inside said second carton and wherein at least one of said triangular-shaped cavities contains a triangular-shaped spacer of about the same dimensions as said cavity to prevent rotation of said first carton within said second carton and also to provide additional stiffness and rigidity to said package.

14. The package of claim 13 wherein at least two, diametrically opposed of said cavities each contain one of said spacers.

15. The package of claim 14 wherein said spacers are each formed from a unitary paperboard blank folded along at least two parallel fold lines.

16. The package of claim 15 wherein said spacers each contain two longitudinal edges which butt against each other at a respective inside corner of said second carton inside said cavity.

* * * * *